US006364967B1

(12) United States Patent
Yamamoto et al.

(10) Patent No.: US 6,364,967 B1
(45) Date of Patent: Apr. 2, 2002

(54) HIGH-STRENGTH, HIGH-TOUGHNESS ROLLED SHAPE STEEL AND METHOD OF PRODUCING THE SAME

(75) Inventors: Kouichi Yamamoto; Hironori Satoh; Suguru Yoshida, all of Futtsu; Hirokazu Sugiyama, Sakai; Hiroyuki Hasegawa, Kimitsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/509,956

(22) PCT Filed: Jul. 29, 1999

(86) PCT No.: PCT/JP99/04078

§ 371 Date: Mar. 30, 2000

§ 102(e) Date: Mar. 30, 2000

(87) PCT Pub. No.: WO00/06789

PCT Pub. Date: Feb. 10, 2000

(30) Foreign Application Priority Data

Jul. 31, 1998 (JP) ..... 10/217537

(51) Int. Cl.[7] ..... C22C 38/17; C22C 38/14; C21D 8/00

(52) U.S. Cl. ..... 148/320; 148/333; 148/334; 148/335; 148/330; 148/648; 148/653; 148/654

(58) Field of Search ..... 148/320, 333, 148/334, 335, 330, 644, 648, 654, 653

(56) References Cited

U.S. PATENT DOCUMENTS 5,743,972 A * 4/1998 Kimura et al. ..... 148/330
5,882,447 A * 3/1999 Kimura et al. ..... 148/654

FOREIGN PATENT DOCUMENTS

| | | |
|---|---|---|
| JP | 6250548 | 9/1994 |
| JP | 6254862 | 9/1994 |
| JP | 9-41080 | 2/1997 |
| JP | 10-147834 | 6/1998 |
| JP | 10-147835 | 6/1998 |

OTHER PUBLICATIONS

Patent Abstracts of Japan, vol. 1998, No. 11, Sep. 30, 1998 (Sep. 30, 1998) & JP 10 147834 A (Nippon Steel Corp.), Jun. 2, 1998 .

Patent Abstracts of Japan, vol. 1997, No. 4, Apr. 30, 1997 & JP 08 325635 A (Sumitomo Metal Ind. Ltd.), Dec. 10, 1996.

Patent Abstracts of Japan, vol. 1997 No. 02, Feb. 28, 1997 & JP 08 283900 A (Nippon Steel Corp.), Oct. 29, 1996.

Patent Abstracts of Japan, vol. 1996, No. 02, Feb. 29, 1996 & JP 07 252586 A (Nippon Steel Corp.), Oct. 3, 1995.

Patent Abstracts of Japan, vol. 017, No. 080 (M–1368), Feb. 17, 1993 & JP 04 279247 A (Nippon Steel Corp.), Oct. 5, 1992.

* cited by examiner

*Primary Examiner*—Deborah Yee
(74) *Attorney, Agent, or Firm*—Kenyon & Kenyon

(57) ABSTRACT

A 590 MPa-class rolled steel shape of high strength and excellent toughness for use as a building structural member and a method of producing the high-tensile rolled steel shape are provided. Strength optimization by an alloy that elevates hardenability, texture refinement obtained by fine dispersion of Ti oxides and TiN owing to Ti addition, precipitation strengthening by Cu addition, and formation of a fine bainite texture by temperature-controlled rolling, cooling control and the like enable a high-strength, high-toughness rolled steel shape of high-strength and excellent toughness having mechanical properties of a tensile strength of not less than 590 MPa, a yield strength or 0.2% proof strength of not less than 440 MPa and a Charpy impact absorption energy at 0° C. of not less than 47 J, and method of producing the same.

6 Claims, 1 Drawing Sheet

HIGH-STRENGTH, HIGH-TOUGHNESS ROLLED SHAPE STEEL AND METHOD OF PRODUCING THE SAME

TECHNICAL FIELD

The present invention relates to a high-tensile rolled steel shape, excellent in toughness, for use as a building structural member.

BACKGROUND TECHNOLOGY

Owing to the trend toward super high-rise buildings, stricter building safety standards and the like, steel materials used for columns, e.g., especially thick, large-sized H-shapes (hereinafter called "super-thick H-shapes"), are required to have enhanced high-strength, high-toughness and low-yield-ratio properties. The conventional practice for achieving these desired properties has been to conduct annealing or other such heat treatment after rolling. However, imparting heat treatment degrades energy-cost performance and production efficiency. It therefore considerably increases cost and is a problem from the aspect of economy. Solving this problem required the development of a slab with a new alloy design enabling achievement of high-performance material properties and of a method of producing the slab.

When a steel shape having a flange, e.g., an H-shape, is produced by universal rolling, differences in the rolling finishing temperature, reduction ratio and cooling rate generally arise among the web, flange and fillet portions owing to restrictions on the rolling conditions (temperature and draft), from the aspect of roll shaping, and to the shape. As a result, differences in strength, ductility and toughness occur among the different portions so that portions may arise that, for example, fail to meet the criteria for rolled steels for welded structures (JIS G3106) and the like. In particular, when a super-thick H-shape is produced by rolling using a continuously cast slab as starting material, the rolling must be conducted at a low reduction ratio because the limited maximum slab thickness obtainable by production with a continuous casting machine makes it impossible to obtain a slab of sectional area sufficient for shaping. In addition, since high-temperature rolling is desired in order to obtain the required dimensional precision of the product by roll shaping, the thick flange portion is rolled at a high temperature and cooling of the steel material after rolling proceeds slowly. This results in a coarse microstructure that degrades strength and toughness.

Although TMCP (Thermo-Mechanical-Control Process) is available as a texture refining method in the rolling process, low-temperature, large-reduction-ratio TMCP such as applied to steel plate is hard to apply in steel shape rolling because of the restrictions on the rolling conditions. In the steel plate field, technologies have been introduced for production of high-strength, high-toughness steels that utilize the precipitation effect of VN. See, for example, Japanese Patent Publication Nos. 62(1987)-50548 and 62(1987)-54862. When these methods are applied to 590-MPa-class production, however, the presence of solid-solution N at high concentration causes high-carbon island-like martensite (hereinafter designated as "M*") in the produced bainite texture. Since this markedly degrades toughness, a problem arises of not being able to meet the standards. On the other hand, Japanese Unexamined Patent Publication No. 10-147835 teaches a method for producing a high-strength rolled steel shape by adding minute amounts of Nb, V and Mo, reducing carbon and nitrogen to low levels, imparting texture refinement by fine dispersion of Ti oxides and TiN, and conducting accelerated cooling type controlled rolling. Owing to the utilization of C reduction and TMCP, however, this method increases production cost and complicates the production process.

In order to overcome the forgoing problems, the texture of the rolled steel shape must be refined by producing low-carbon bainite that generates little M*. For this, refinement of the γ grain diameter at the time of rolling and heating must be ensured by, in the steelmaking process, producing the slab by finely crystallizing Ti—O in the slab beforehand, finely precipitating TiN with the Ti—O as nuclei, and, in addition, lowering the carbon content by adding a minute amount of a microalloy that imparts high-strength at a very low content. Moreover, the fillet portion at the joint between the flange and web of an H-shape coincides with the central segregation zone of a CC slab. The MnS in this segregation zone is drawn markedly by rolling. In some cases, the high-concentration element segregation zone and the drawn MnS in this region markedly degrade reducibility and toughness in the thickness direction and further cause lamellar tear during welding. Preventing generation of MnS having these harmful effects is a major issue. Existing technologies are thus not capable of online production and inexpensive supply of the desired high-reliability, high-strength and high-toughness rolled steel shapes.

DISCLOSURE OF THE INVENTION

An object of the present invention is to enable production of a high-tensile rolled steel shape at low cost without conducting conventional heat treatment such as annealing, thereby providing a 590-MPa-class rolled steel shape of high-strength and excellent toughness for use as a building structural member, and a method of producing the same.

The characterizing feature of the present invention resides in the point that, in a departure from conventional thinking, a high-strength and high-toughness rolled steel shape is realized through texture refinement achieved by addition of Ti, fine dispersion of fine Ti oxides and TiN produced as a result, and generation of a low-carbon bainite structure by addition of a microalloy.

In addition, the TMCP adopted is characterized in being a method of effecting water cooling between rolling passes and repeating rolling and water cooling, thereby enabling effective texture grain refinement even by low-reduction hot rolling during steel shape rolling instead of the high-reduction rolling utilized for steel plate.

The present invention is characterized in casting a slab to obtain a fine texture of low-carbon bainite of small M* content and conducting effective TMCP during steel shape rolling of this slab to produce a steel shape having high-strength and high-toughness.

The slab is produced so as to achieve γ grain refinement during rolling and heating by, during the steelmaking process, adding Ti to the slab to crystallize fine Ti—O and finely disperse TiN, adding an alloying element which secures strength and toughness with the aim of reducing M* in the texture after rolling, and making the B content very low.

The slab is then roll-shaped to produce a steel shape. In this rolled steel shape rolling process, the steel is imparted with a temperature difference between the surface layer portion and the interior by water cooling the steel between hot rolling passes so as to heighten penetration of reduction into the hot steel interior even under mild reduction conditions, thereby introducing working dislocations that act as bainite formation nuclei in the Γ grains and thus increasing the number of formation nuclei thereof. In addition, refinement of the microstructure can be achieved by the method of effecting cooling control of the γ/α transformation temperature after rolling so as to suppress growth of the bainite whose nuclei were formed, whereby control-rolled steel shape with a low production cost can be produced at high efficiency. The aforesaid problems were overcome based on this knowledge, the gist of which is as follows.

(1) A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in comprising, in percentage by weight,

C: 0.02–0.06%,

Si: 0.05–0.25%,

Mn: 1.2–2.0%,

Cu: 0.3–1.2%,

Ni: 0.1–2.0%,

Ti: 0.005–0.025%,

Nb: 0.01–0.10%,

V: 0.04–0.10%,

N: 0.004–0.009%, and

O: 0.002–0.004%, the balance being Fe and unavoidable impurities, having a chemical composition wherein among the impurities B is limited to not more than 0.0003% and Al content is limited to not more than 0.005%, and having a microstructure wherein the area ratio of bainite is not greater than 40% and the remainder is ferrite, pearlite and high-carbon island-like martensite, the area ratio of the high-carbon island-like martensite being not greater than 5%.

(2) A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in comprising, in percentage by weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, having a chemical composition wherein among the impurities B is limited to not more than 0.0003% and Al content is limited to not more than 0.005%, and having a microstructure wherein the area ratio of bainite is not greater than 40% and the remainder is ferrite, pearlite and high-carbon island-like martensite, the area ratio of the high-carbon island-like martensite being not greater than 5%.

(3) A method of producing a high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in starting rolling of a slab after heating to a temperature range of 1100–1300° C. and effecting at least one or a combination of a plurality of the methods of 1) in the rolling step, effecting rolling of not less than 10% in terms of thickness ratio at a shape flange surface temperature of not higher than 950° C., 2) in the rolling step, effecting not less than one water-cooling/rolling cycle of water-cooling the shape flange surface temperature to not higher than 700° C. and rolling during recuperation, 3) after completion of the rolling, cooling the shape flange average temperature at a cooling rate in the range of 0.1° C.–5° C./s to a temperature range of 700–400° C. and thereafter allowing spontaneous cooling, and 4) after the shape flange average temperature has once been cooled to not higher than 400° C., reheating to a temperature range of 400–500° C., retaining for 15 minutes to 5 hours, and recooling, the slab comprising, in percentage by weight,

C: 0.02–0.06%,

Si: 0.05–0.25%,

Mn: 1.2–2.0%,

Cu: 0.3–1.2%,

Ni: 0.1–2.0%,

Ti: 0.005–0.025%,

Nb: 0.01–0.10%,

V: 0.04–0.10%,

N: 0.004–0.009%, and

O: 0.002–0.004%, the balance being Fe and unavoidable impurities, and having a chemical composition wherein among the impurities B is limited to not more than 0.0003% and Al content is limited to not more than 0.005%.

(4) A method of producing a high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in starting rolling of a slab after heating to a temperature range of 1100–1300° C. and effecting at least one or a combination of a plurality of the methods of 1) in the rolling step, effecting rolling of not less than 10% in terms of thickness ratio at a shape flange surface temperature of not higher than 950° C., 2) in the rolling step, effecting not less than one water-cooling/rolling cycle of water-cooling the shape flange surface temperature to not higher than 700° C. and rolling during recuperation, 3) after completion of the rolling, cooling the shape flange average temperature at a cooling rate in the range of 0.1° C.5° C./s to a temperature range of 700–400° C. and thereafter allowing spontaneous cooling, and 4) after the shape flange average temperature has once been cooled to not higher than 400° C., reheating to a temperature range of 400–500° C., retaining for 15 minutes to 5 hours, and recooling, the slab comprising, in percentage by weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, and having a chemical composition wherein among the impurities B is limited to not more than 0.0003% and Al content is limited to not more than 0.005%.

(5) A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in comprising, in percentage by weight,

C: 0.02–0.06%,

Si: 0.05–0.25%,

Mn: 1.2–2.0%,

Cu: 0.3–1.2%,

Ni: 0.1–2.0%,

Ti: 0.005–0.025%,

Nb: 0.01–0.10%,

V: 0.04–0.10%,

N: 0.004–0.009%, and

O: 0.002–0.004%, the balance being Fe and unavoidable impurities, having a chemical composition wherein among the impurities B is limited to not more than 0.0003% and Al content is limited to not more than 0.005%, and being produced by hot rolling a sectional shape combining two or more plates of thickness in the range of 15–80 mm and thickness ratio in the range of 0.5–2.0.

(6) A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47J, characterized in comprising, in percentage by weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, having a chemical composition wherein among the impurities B is limited to not more than 0.0003% and Al content is limited to not more than 0.005%, and being produced by hot rolling a sectional shape combining two or more plates of thickness in the range of 15–80 mm and thickness ratio in the range of 0.5–2.0.

BEST MODES FOR CARRYING OUT THE INVENTION

Figure 1:
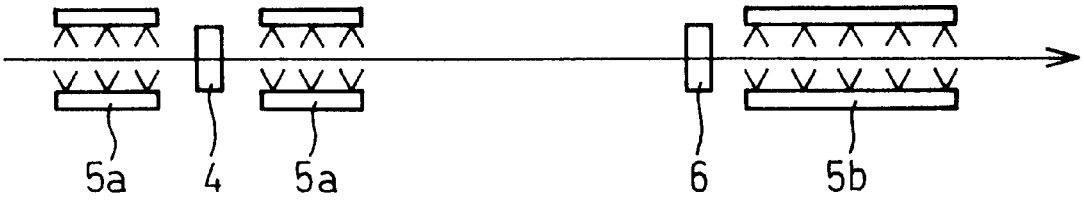
FIG. 1 is a diagram showing an example of equipment layout for carrying out the method of the present invention.

The present invention will be explained in detail in the following.

Strengthening of a steel is achieved by 1) ferrite crystal refinement, 2) solution hardening by alloying elements, dispersion hardening by hardening phase, 3) precipitation hardening by fine precipitates, and the like. High toughness is achieved by 4) crystal refinement, 5) reduction of matrix (ferrite) solid-solution N and C, 6) reduction and refinement of high-carbon martensite and coarse oxides and precipitates of hardening phase that become fracture starting points, and the like.

Ordinarily, steel strengthening degrades toughness, so that strengthening and toughness enhancement require incompatible measures. Only one metallurgical factor enables both simultaneously: crystal refinement.

A characterizing feature of the present invention is that high-strength and high-toughness are realized through texture refinement achieved by, in the steelmaking process, dispersing fine Mg oxides produced by Mg addition and TiN and establishing a low-carbon bainite texture based on a microalloying alloy design.

In addition, in the hot-rolling process, the present invention repeats a step of water cooling the flange surfaces between rolling passes and rolling during recuperation, thereby imparting a reduction penetration effect to the central portion of flange thickness, enhancing the texture refinement effect of TMCP at this region, and, by this texture refinement, improving the mechanical properties of the matrix at the different portions of the H-shape and reducing the scattering thereof to achieve uniformity.

The reasons for the limitations on the component ranges and control conditions of the invention steel shape will be explained in the following.

C is added to strengthen the steel. At a C content of less than 0.02% the strength required of a structural steel cannot be obtained. When C is added in excess of 0.06%, the matrix toughness, weld cracking property, the weld heat affected zone (hereinafter abbreviated as "HAZ") toughness and the like are markedly degraded. The lower limit is therefore set at 0.02% and the upper limit at 0.06%.

Si is necessary for securing matrix strength, preliminary deoxidation of the steel melt and the like. When Si is present in excess of 0.25%, high-carbon island-like martensite is produced in the hardening texture of the matrix and HAZ to cause marked degradation of the matrix and weld joint toughness. When Si is present at less than 0.05%, preliminary deoxidation of the steel melt cannot be sufficiently conducted. Si content is therefore limited to the range of 0.05–0.25%.

Mn must be added at not less than 1.2% to secure matrix strength but its upper limit is set at 2.0% in view of the allowable concentration with regard to matrix and weld toughness, fracture property, and the like.

During retention and gradual cooling in the a temperature range, Cu precipitates a Cu phase on dislocations in the a phase and the normal temperature strength of the matrix is increased by the precipitation hardening thereof. At a Cu content of less than 0.3%, however, Cu in the a phase is within the solid solution limit and strengthening by Cu precipitation cannot be obtained because no precipitation occurs. At a Cu content of 1.2% or greater, the precipitation strengthening saturates. The Cu content is therefore set at 0.3–1.2%.

Ni is a very effective element for elevating strength and toughness of the matrix. A Ni content of 0.1% or greater is necessary for manifestation of this effect. However, addition in excess of 2.0% increases alloy cost and is uneconomical. The upper limit is therefore set at 2.0%.

Ti precipitates TiN and by reducing solid solution N controls generation of M*. In addition, finely precipitated TiN contributes to γ phase refinement. These actions of Ti refine the texture and improve strength and toughness. Therefore, since TiN precipitation amount is deficient and these effects cannot be obtained at a Ti content of less than 0.005%, the lower limit of Ti content is set at 0.005%. When the content exceeds 0.025%, however, excess Ti precipitates TiC and the precipitation hardening by TiC degrades the toughness of the matrix and weld heat affected zones. Ti content is therefore limited to not more than 0.025%.

Nb is added for the purpose of elevating hardenability to increase strength. A Nb content of 0.01% or greater is necessary for manifestation of this effect. At a content greater than 2.0%, however, the amount of Nb carbonitride increases and the effect as solid solution Nb saturates. The Nb content is therefore limited to not more than 0.10%.

The rolled texture can be refined by addition of a small amount of V. Since strengthening is produced by vanadium carbonitride precipitation, low alloying can be achieved to improve welding property. A V content of 0.04% is necessary for the manifestation of this effect. However, excess V addition causes weld hardening and raises the matrix yield point. The upper limit of V content is therefore set at 0.10%.

Although N increases strength by entering α in solid solution, it degrades toughness by generating M* in the upper bainite texture. Solid solution N must therefore be reduced to as low as possible. In the present invention, however, N is added for the purpose of combining it with Ti to finely precipitate TiN and reduce solid solution N in the steel, whereupon crystal grain growth by TiN is suppressed to produce a texture refinement effect. At an N content of less than 0.004%, the amount of TiN precipitation is insufficient for achieving this effect, and when it exceeds 0.009%, although the precipitated amount is sufficient, coarse TiN precipitates to degrade toughness. N is therefore limited to 0.004–0.009%.

O (oxygen) is indispensable for forming Ti—O and for this purpose must be contained in excess of 0.002%. When it is contained in excess of 0.004%, however, the formed Ti—O grains become coarse and degrade toughness. The O content is therefore limited to 0.002–0.004%.

The amounts of P and S contained as impurities are not particularly limited. Since P and S are a cause for weld fracture and toughness degradation owing to solidification segregation, however, they should be reduced to the utmost possible. The amount of each is preferably limited to less than 0.002%.

Addition of a small amount of B increases hardenability and contributes to strength enhancement. However, it was found that when B is contained in excess of 0.0003%, it forms M* in the upper bainite texture, which markedly degrades toughness. B is therefore instead treated as an impurity and limited in content to not greater than 0.0003%.

The reason for limiting Al to not greater than 0.005% is that Al is a strong deoxidation element which hinders Ti—O formation when contained in excess of 0.005%. As this makes fine dispersion impossible, Al is treated as an impurity and limited to not more than 0.005%.

In addition, depending on the steel type of the steel shape of the present invention, one or more of Cr, Ni, Mo, Mg and Ca can be incorporated in addition to the foregoing elements for the purpose of increasing matrix strength and enhancing the toughness of the matrix.

Cr is effective for strengthening the matrix by improving hardenability. Cr content of 0.1% or greater is necessary for manifestation of this effect. However, an excess addition of over 1.0% is harmful from the aspects of toughness and hardenability. The upper limit is therefore set at 1.0%.

Mo is an element effective for securing matrix strength. Mo content of 0.05% or greater is necessary for manifestation of this effect. However, when Mo is present in excess of 0.4%, Mo carbide ($Mo_2C$) precipitates and the hardenability improving effect as solid solution Mo saturates. The upper limit is therefore set at 0.4%.

The Mg alloys used for Mg addition are Si—Mg—Al and Ni—Mg. The reason for using a Mg alloy is that alloying lowers the Mg content concentration and suppresses deoxidation reaction during addition to the steel melt, whereby safety can be maintained at the time of addition and Mg yield can be improved. The reason for limiting Mg to 0.0005–0.005% is that addition in excess of 0.005% produces no further increase in yield because Mg is also a strong deoxidation element and the crystallized Mg oxides readily separate by flotation in the steel melt. The upper limit is therefore set at 0.005%. At less than 0.0005% the desired dispersion concentration of the Mg-system oxides is insufficient. The lower limit is therefore set at 0.0005%. Although MgO is the main notation for the Mg-system oxides referred to here, by electron microscope analysis or the like it is found that this oxide forms complex oxides with Ti, trace amount of Al, and Ca contained as impurity.

The reason for limiting Ca content to 0.001–0.003% is that addition in excess of 0.003% produces no further increase in yield because Ca is a strong deoxidation element and the crystallized Ca oxide readily separates by flotation in the steel melt. The upper limit is therefore set at 0.003%. At less than 0.001% the desired dispersion concentration of the Mg-system oxides is insufficient. The lower limit is therefore set at 0.001%.

In order to simultaneously secure 590 MPa (60 kgf/mm$^2$)-class tensile strength and toughness, the rolling of the present invention needs to have a microstructure wherein the area ratio of bainite in the microstructure is not greater than 40% and the remainder is ferrite, pearlite and high-carbon island-like martensite, the area ratio of the high-carbon island-like martensite being not greater than 5%.

The reason for defining the area ratio of bainite in the microstructure as not greater than 40%, the remainder as ferrite, pearlite and high-carbon island-like martensite, and area ratio of the high-carbon island-like martensite as not greater than 5% is that when either the bainite area ratio or the high-carbon island-like martensite area ratio exceeds the aforesaid upper limit, toughness deteriorates. The densities are therefore restricted to a range not greater than the aforesaid upper limits.

The aforesaid microstructure can be realized by the method of the present invention. Specifically, a slab having the aforesaid chemical composition is reheated to the temperature range of 1100–1300° C. The reason for limiting the reheating temperature to this temperature range is that in steel shape production by hot working heating to a temperature of 1100° C. or higher is necessary in order to facilitate plastic deformation. Further, the lower limit of the reheating temperature is set at 1100° C. owing to the need to put elements such as V and Nb thoroughly into solid solution. The upper limit is set at 1300° C. in light of heating furnace performance and economy.

The slab heated in the foregoing manner is preferably subjected to at least one or a combination of a plurality of the processes of 1) in the rolling step, effecting rolling of not less than 10% in terms of thickness ratio at a shape flange surface temperature of not higher than 950° C., 2) in the rolling step, effecting not less than one water-cooling/rolling cycle of water-cooling the shape flange surface temperature to not higher than 700° C. and rolling during recuperation, 3) after completion of the rolling, cooling the shape flange average temperature at a cooling rate in the range of 0.1° C.5° C./s to a temperature range of 700–400° C. and thereafter allowing spontaneous cooling, and 4) after the shape flange average temperature has once been cooled to not higher than 400° C., reheating to the temperature range of 400–500° C., retaining for 15 minutes to 5 hours, and recooling.

For 1), it is necessary in the step of rolling the slab heated in the foregoing manner to effect rolling of not less than 10% in terms of thickness ratio at a shape flange surface temperature of not higher than 950° C. The reason for conducting rolling at a shape flange surface temperature of not higher than 950° C. to obtain a total reduction of not less than 10% is that refinement effect by controlled rolling cannot be anticipated from reduction at a higher temperature than this and that the refinement effect of total reduction of not greater than 10% at not higher than 950° C. is small.

In 2), not less than one water-cooling/rolling cycle is conducted wherein water cooling is effected between hot-rolling passes, the flange surface temperature is cooled to not higher than 700° C. during rolling by the water cooling, and rolling is then conducted while the recuperation of the next interpass is in progress. This is to impart a temperature difference between the surface layer portion and interior of the flange so as to enable the working deformation to penetrate to the interior even under mild reduction conditions and to utilize water cooling for achieving rapid low-temperature rolling that enables TMCP to conducted efficiently. The purpose of conducting rolling during recuperation after cooling the flange surface temperature to not higher than 700° C., is to soften the surface by suppressing quench hardening owing to accelerated cooling after finish rolling. The reason is that if the flange surface temperature is cooled to not higher than 700° C., the temperature once falls below the $\gamma/\alpha$ transformation temperature, the surface portion undergoes recuperation temperature increase by the time of the next rolling, the rolling constitutes working in the y/a two-phase coexistence temperature range, and a mixed texture of refined y grains and worked fine a is formed. By this the hardenability of the surface portion is markedly decreased so that hardening of the surface by accelerated cooling can be prevented.

In 3), immediately upon completion of rolling, the shape flange average temperature is cooled at a cooling rate in the range of 0.1° C.–5° C./s to a temperature range of 700–400° C. and thereafter allowed to cool spontaneously. The purpose of this is to obtain high-strength and high-toughness by effecting accelerated cooling to form nuclei and suppress grain growth of ferrite and to refine the bainite texture. The accelerated cooling is stopped at 700–400° C. because when it is stopped at a temperature higher than 700° C., part of the surface layer portion rises above the Ar1 point, causing $\gamma$ phase to remain, and this $\gamma$ phase transforms to ferrite using coexistent ferrite as nuclei, while, in addition, ferrite grains grow and become coarse. The accelerated cooling termination temperature is therefore set at not higher than 700° C. On the other hand, with cooling to lower than 400° C., high-carbon martensite formed between the bainite laths during the succeeding spontaneous cooling precipitates cementite during cooling to become incapable of decomposition and thus remains as a hardening phase. This high-carbon martensite acts as starting points for brittle fracture and is therefore a cause of toughness degradation. For these reasons, the accelerated cooling termination temperature is limited to 700–400° C.

In 4, after the shape flange average temperature has once been cooled to not higher than 400° C., it is reheated to the temperature range of 400–500° C., retained for 15 minutes to 5 hours, and recooled. The reason for this is that it can be implemented by heating and retention with a heating furnace capable of temperature-controlling the once cooled steel up to around 500° C.

The reason for implementing this production method is to reheat the high-carbon island-like martensite present in the microstructure in the as-rolled state to 400–500° C. so as to decompose the island-like martensite by dispersing C therein into the matrix. This enables toughness improvement by reducing the island-like martensite area ratio.

Adoption of production method 2) is preferable in actual production of steel shapes. This is because the process of 2) can encompass all sizes at maximum efficiency and low cost. Although the production methods 1) and 3) impair production efficiency, they are effective in the point of their improvement of mechanical properties. The process of 4) is aimed at offline production and is a process that can provide the desired product without adopting any of the process 1), 2) and 3).

The steel shape according to the present invention is specified to be produced by hot rolling a sectional shape combining two or more plates of thickness in the range of 15–80 mm and thickness ratio in the range of 0.5–2.0. This is because H-shapes of large thickness size are the main steel materials used for columns. The maximum thickness is therefore defined as 80 mm. With a steel material having thickness greater than 80 mm, construction work efficiency is low because the number of passes during multilayer welding becomes extremely large. The lower limit value of thickness is defined as 15 mm because a thickness of 15 mm is needed to ensure the strength required of a column material and the strength requirement cannot be satisfied at a less than 15 mm. The thickness ratio is further limited to 0.5–2.0 for the following two reasons. In the case of producing an H-shape by hot rolling, if the flange/web thickness ratio exceeds 2.0, web seat layering caused by difference in elongation ratio and web plastic deformation caused by difference in cooling rate after hot rolling produce shape defects, known as web waves, such that the web is changed to an undulating shape. The upper limit of the thickness ratio is therefore set at 2.0. On the other hand, H-column web thickness is a critical factor in suppressing H-column-beam joint deformation in an architectural structure. From the viewpoint of the current state of use reinforced by a steel plate called a doubler plate and of preventing deformation, H-columns are required that are structured to have a thickness ratio whereby the web thickness is greater than the flange thickness, and since shape defects arise owing to undulation of the flange by a phenomenon similar to the web wave mechanism described above when the thickness ratio is less than 0.5, the lower limit of the thickness ratio is set at 0.5.

"Thickness" as termed with respect to the present invention means either flange/web thickness ratio or web/flange thickness ratio.

EXAMPLE

For trial production of steel shapes, steel made in a converter was added with alloy, subjected to preliminary deoxidation to regulate the oxygen content of the steel melt, successively added with Ti and Mg alloy, and continuously cast into a 250–300-mm thick slab. Cooling of the slab was controlled by selecting the amount of water of a secondary cooling zone under the mold and the slab extraction rate. The slab was heated to 1300° C. and rolled into an H-shape using a line equipped with a universal rolling mill as shown in FIG. 1, from which diagram the rough rolling process has been omitted. For water cooling between rolling passes, water cooling devices 5*a* were installed before and after an intermediate universal rolling mill 4 and spray-cooling of the flange outside surfaces and reverse rolling were repeated. For accelerated water cooling, rolling was conducted with a finish universal rolling mill 6, followed by cooling with water. As required depending on the steel type, after completion of rolling, the flange outer surface was spray-cooled by a cooling device 5*b* disposed at the rear surface thereof.

Figure 2:
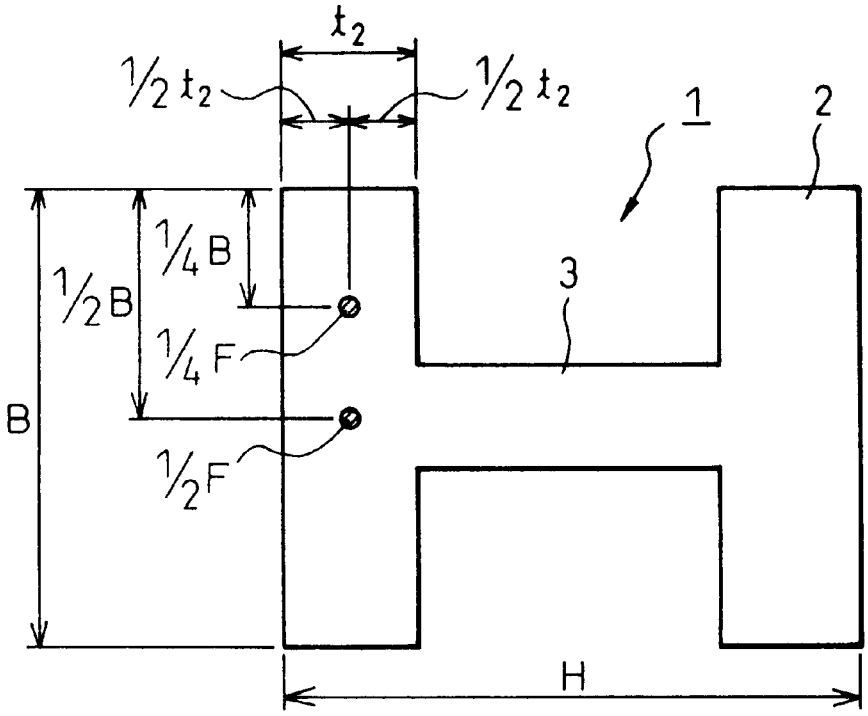
FIG. 2 is a schematic illustration showing the sectional shape of an H-shape and the location from which mechanical test pieces were taken.

The mechanical properties were determined using tests pieces taken from an H-shape having a flange 2 and a web 2, shown in FIG. 2, at the center portion of the thickness t2 of the flange 2 (½ t2) over ¼ and ½ the total flange width (B) (over ¼ B and ½ B). The properties were determined at these locations because the flange ¼ F portion exhibits average mechanical properties of the H-shape and these properties decrease most at the flange ½ F portion, so that it was considered that the mechanical test properties of the H-shape could be represented by these two locations.

The chemical compositions of the invention steels are shown in Table 1.

Table 2 shows the production method of each invention steel shown in Table 1, the mechanical test property values of the respective H-shapes, and the bainite and M* areas. The hot-rolling temperature was made uniform at 1300° C. because it is generally known to refine γ particles and improve mechanical test properties by lowering heating temperature. Therefore, on the assumption that the mechanical properties would exhibit the lowest values under a high-temperature heating condition, it was considered that such values could represent the mechanical test characteristics at lower heating temperatures.

As shown in Table 2, all rolled steel shapes produced according to the present invention exhibited mechanical properties of a tensile strength of not less than 590 MPa, a yield strength or 0.2% proof strength of not less than 440 MPa and a Charpy impact absorption energy at 0° C. of not less than 47J.

TABLE 1

| Test piece no. | C | Si | Mn | P | S | Cu | Ni | Cr | V | Ti | Al | Mo | O | N | Nb | B | H | Mg |
|---|---|---|---|---|---|---|---|---|---|---|---|---|---|---|---|---|---|---|
| 1 | 0.040 | 0.147 | 1.57 | 0.007 | 0.0031 | 0.95 | 1.00 | | 0.069 | 0.011 | 0.003 | | 0.0017 | 0.0090 | 0.030 | 0.0001 | 0.00013 | |
| 2 | 0.041 | 0.160 | 1.58 | 0.003 | 0.0028 | 0.96 | 0.98 | | 0.073 | 0.014 | 0.004 | | 0.0020 | 0.0079 | 0.032 | 0.0001 | 0.00010 | |
| 3 | 0.041 | 0.148 | 1.53 | 0.006 | 0.0024 | 0.98 | 0.96 | | 0.070 | 0.015 | 0.005 | | 0.0026 | 0.0074 | 0.033 | 0.0001 | 0.00012 | |
| 4 | 0.044 | 0.147 | 1.57 | 0.007 | 0.0020 | 0.99 | 0.98 | | 0.071 | 0.013 | 0.003 | | 0.0026 | 0.0068 | 0.032 | 0.0002 | 0.00010 | |
| 5 | 0.030 | 0.150 | 1.45 | 0.010 | 0.0050 | 1.00 | 1.01 | | 0.006 | 0.001 | 0.005 | 0.310 | | 0.0020 | 0.020 | 0.0001 | | |
| 6 | 0.040 | 0.150 | 1.43 | 0.009 | 0.0040 | 0.01 | 0.01 | 0.020 | 0.057 | 0.013 | 0.003 | | | | 0.097 | 0.0001 | | |
| 7 | 0.040 | 0.100 | 1.25 | 0.010 | 0.0041 | 0.50 | 0.50 | 0.020 | 0.058 | 0.010 | 0.003 | | 0.0020 | 0.0031 | 0.057 | 0.0001 | | |
| 8 | 0.060 | 0.100 | 0.90 | 0.011 | 0.0057 | 0.49 | 0.50 | 0.020 | 0.057 | 0.010 | 0.003 | | 0.0020 | 0.0030 | 0.060 | 0.0001 | | 0.002 |
| 9 | 0.050 | 0.100 | 1.44 | 0.010 | 0.0067 | 0.50 | 0.30 | 0.020 | 0.053 | 0.010 | 0.003 | | | | 0.059 | 0.0001 | | |
| 10 | 0.060 | 0.100 | 1.45 | 0.010 | 0.0069 | 0.50 | 0.30 | 0.030 | 0.054 | 0.010 | 0.003 | | 0.0020 | 0.0031 | 0.061 | 0.0001 | | |
| 11 | 0.040 | 0.100 | 1.45 | 0.010 | 0.0032 | 0.51 | 0.50 | 0.030 | 0.055 | 0.009 | 0.002 | 0.300 | | | 0.020 | 0.0001 | | |
| 12 | 0.040 | 0.100 | 1.44 | 0.011 | 0.0031 | 0.50 | 0.50 | 0.030 | 0.056 | 0.011 | 0.002 | 0.300 | 0.0020 | 0.0031 | 0.060 | 0.0001 | | |
| 13 | 0.040 | 0.100 | 1.44 | 0.010 | 0.0038 | 0.50 | 0.50 | 0.030 | 0.058 | 0.013 | 0.003 | 0.300 | | | 0.100 | 0.0001 | | |
| 14 | 0.050 | 0.100 | 1.45 | 0.010 | 0.0046 | 0.03 | 0.01 | 0.500 | 0.009 | 0.012 | 0.003 | 0.310 | 0.0020 | 0.0032 | 0.102 | 0.0001 | | |
| 15 | 0.050 | 0.100 | 0.99 | 0.010 | 0.0056 | 0.50 | 0.50 | 0.020 | 0.056 | 0.010 | 0.003 | 0.300 | 0.0020 | 0.0030 | 0.060 | 0.0001 | | 0.003 |
| 16 | 0.050 | 0.100 | 1.22 | 0.010 | 0.0039 | 0.52 | 0.51 | 0.020 | 0.055 | 0.010 | | 0.310 | 0.0020 | 0.0033 | 0.060 | 0.0001 | | |
| 17 | 0.050 | 0.100 | 1.45 | 0.011 | 0.0043 | 0.51 | 0.50 | 0.020 | 0.056 | 0.010 | | 0.300 | 0.0020 | 0.0033 | 0.058 | 0.0001 | | |
| 18 | 0.050 | 0.100 | 1.00 | 0.011 | 0.0048 | 0.50 | 0.50 | 0.020 | 0.001 | 0.009 | 0.001 | 0.300 | 0.0020 | 0.0033 | 0.059 | 0.0001 | | |
| 19 | 0.050 | 0.100 | 1.20 | 0.010 | 0.0049 | 0.50 | 0.50 | 0.020 | 0.001 | 0.010 | 0.001 | 0.300 | 0.0020 | 0.0033 | 0.060 | 0.0001 | | |
| 20 | 0.050 | 0.100 | 1.47 | 0.010 | 0.0053 | 0.50 | 0.50 | 0.020 | 0.002 | 0.009 | 0.001 | 0.300 | 0.0020 | 0.0033 | 0.060 | 0.0001 | | |
| 21 | 0.040 | 0.100 | 1.45 | 0.011 | 0.0052 | 0.30 | 0.30 | 0.020 | 0.060 | 0.010 | 0.003 | 0.300 | 0.0021 | 0.0032 | 0.059 | 0.0001 | | |
| 22 | 0.040 | 0.100 | 1.44 | 0.011 | 0.0053 | 0.48 | 0.30 | 0.020 | 0.058 | 0.010 | 0.003 | 0.300 | | | 0.058 | 0.0001 | | |
| 23 | 0.050 | 0.100 | 1.44 | 0.010 | 0.0041 | 0.51 | 0.30 | 0.030 | 0.002 | 0.010 | 0.004 | 0.300 | 0.0020 | 0.0032 | 0.058 | 0.0001 | | 0.002 |
| 24 | 0.050 | 0.080 | 1.44 | 0.010 | 0.0040 | 0.50 | 0.30 | 0.030 | 0.050 | 0.010 | 0.002 | 0.300 | 0.0020 | 0.0032 | 0.056 | 0.0001 | | |
| 25 | 0.050 | 0.100 | 1.44 | 0.010 | 0.0041 | 0.50 | 0.30 | 0.030 | 0.093 | 0.010 | 0.004 | 0.300 | 0.0020 | 0.0032 | 0.059 | 0.0001 | | |
| 26 | 0.040 | 0.100 | 1.00 | 0.010 | 0.0040 | 0.49 | 0.50 | 0.020 | 0.056 | 0.010 | 0.003 | 0.300 | | | 0.059 | 0.0001 | | |
| 27 | 0.040 | 0.100 | 0.99 | 0.011 | 0.0059 | 0.50 | 0.50 | 0.020 | 0.050 | 0.010 | 0.002 | 0.300 | | | 0.098 | 0.0001 | | |
| 28 | 0.050 | 0.100 | 1.00 | 0.011 | 0.0056 | 0.50 | 0.50 | 0.020 | 0.051 | 0.010 | 0.002 | 0.300 | 0.0020 | 0.0032 | 0.099 | 0.0001 | | |
| 29 | 0.050 | 0.100 | 1.44 | 0.011 | 0.0038 | 0.49 | 0.30 | 0.020 | 0.002 | 0.012 | 0.002 | 0.300 | 0.0020 | 0.0031 | 0.058 | 0.0001 | | |
| 30 | 0.050 | 0.100 | 1.45 | 0.011 | 0.0039 | 0.50 | 0.30 | 0.020 | 0.002 | 0.015 | 0.002 | 0.310 | 0.0020 | 0.0031 | 0.059 | 0.0001 | | |
| 31 | 0.050 | 0.100 | 1.45 | 0.010 | 0.0035 | 0.50 | 0.30 | 0.020 | 0.002 | 0.019 | 0.001 | 0.300 | 0.0020 | 0.0031 | 0.059 | 0.0001 | | |

TABLE 2

| sample | size (Ft) mm | YS MPa | TS MPa | vEO J | Bainite area ratio (%) | Island-like martensite area ratio (%) | Production method* | | | |
|---|---|---|---|---|---|---|---|---|---|---|
| 1 | 65 | 463 | 624 | 108 | 33 | 0.29 | | 2 | | |
| 2 | 80 | 445 | 603 | 133 | 22 | 0.24 | 1 | 2 | | |
| 3 | 55 | 463 | 602 | 158 | 32 | 0.22 | | 2 | | |
| 4 | 80 | 487 | 613 | 62 | 25 | 0.19 | | | | 4 |
| 5 | 25 | 506 | 681 | 108 | 31 | 0.17 | | 2 | | |
| 6 | 25 | 450 | 602 | 232 | 22 | 0.12 | 1 | 2 | 3 | |
| 7 | 25 | 461 | 629 | 175 | 31 | 0.21 | | 2 | | |
| 8 | 25 | 445 | 600 | 193 | 20 | 0.14 | | 2 | | |
| 9 | 25 | 475 | 652 | 80 | 25 | 0.21 | | 2 | | |
| 10 | 25 | 478 | 667 | 87 | 22 | 0.23 | 1 | 2 | | |
| 11 | 25 | 466 | 614 | 157 | 31 | 0.22 | 1 | 2 | | |
| 12 | 25 | 503 | 673 | 63 | 33 | 0.42 | | 2 | | |
| 13 | 25 | 530 | 696 | 53 | 30 | 0.30 | | 2 | | |
| 14 | 25 | 463 | 598 | 223 | 21 | 0.12 | 1 | 2 | | 4 |
| 15 | 25 | 456 | 625 | 144 | 26 | 0.24 | 1 | 2 | | |
| 16 | 25 | 493 | 652 | 58 | 32 | 0.52 | | 2 | | |
| 17 | 25 | 492 | 678 | 61 | 34 | 0.48 | | 2 | | |
| 18 | 25 | 444 | 598 | 210 | 20 | 0.20 | | | 3 | |
| 19 | 25 | 447 | 607 | 201 | 21 | 0.20 | 1 | | 3 | |
| 20 | 25 | 473 | 634 | 113 | 36 | 0.41 | 1 | 2 | 3 | 4 |
| 21 | 25 | 457 | 622 | 128 | 32 | 0.25 | 1 | | | |
| 22 | 25 | 458 | 630 | 129 | 35 | 0.23 | 1 | 2 | 3 | |
| 23 | 25 | 457 | 628 | 80 | 24 | 0.31 | | 2 | | |
| 24 | 25 | 480 | 652 | 54 | 30 | 0.55 | | 2 | | |
| 25 | 25 | 516 | 659 | 76 | 26 | 0.33 | | 2 | | |
| 26 | 25 | 445 | 599 | 150 | 22 | 0.27 | 1 | | | |
| 27 | 25 | 469 | 615 | 137 | 30 | 0.29 | 1 | 2 | | |
| 28 | 25 | 463 | 622 | 203 | 18 | 0.15 | | | | 4 |
| 29 | 25 | 481 | 636 | 139 | 35 | 0.29 | | 2 | | 4 |
| 30 | 25 | 469 | 640 | 207 | 19 | 0.13 | | 2 | 3 | |
| 31 | 25 | 467 | 643 | 115 | 32 | 0.33 | | 2 | | |

Remark: *

1 In the rolling step, rolling of not less than 10% in terms of thickness ratio was effected at a shape flange surface temperature of not higher than 950° C.

2 In the rolling step, not less than one water-cooling/rolling cycle of water-cooling the shape flange surface temperature to not higher than 700° C. and rolling during recuperation was effected.

3 After completion of the rolling, the shape flange average temperature was cooled at a cooling rate in the range of 0.1° C.–5° C./s to a temperature range of 700–400° C. and thereafter allowed to cool spontaneously.

4 After shape the flange average temperature had once been cooled to not higher than 400° C., reheating to a temperature range of 400–500° C., retaining for 15 minutes to 5 hours, and recooling were effected.

1) In the rolling step, rolling of not less than 10% in terms of thickness ratio was effected at a shape flange surface temperature of not higher than 950° C.
2) In the rolling step, not less than one water-cooling/rolling cycle of water-cooling the shape flange surface temperature to not higher than 700° C. and rolling during recuperation was effected.
3) After completion of the rolling, the shape flange average temperature was cooled at a cooling rate in the range of 0.1° C.–5° C./s to a temperature range of 700–400° C. and thereafter allowed to cool spontaneously.
4) After shape the flange average temperature had once been cooled to not higher than 400° C., reheating to a temperature range of 400–500° C., retaining for 15 minutes to 5 hours, and recooling were effected.

Industrial Applicability

Application of the alloy-designed slab and controlled rolling method of the present invention to a rolled steel shape enables production of a steel shape having superior strength and excellent toughness even at the flange ½ thickness, ½ width portion where mechanical strength properties are most difficult to ensure. The industrial effect of the invention is therefore outstanding in the aspects of improvement of large steel structure reliability, safety assurance, economy and the like.

What is claimed is:

1. A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47 J, characterized in comprising, in percentage by weight,

C: 0.02–0-06%,

Si: 0.05–0.25%,

Mn: 1.2–2.0%,

Cu: 0.3–1.2%,

Ni: 0.1–2.0%,

Ti: 0.005–0.025%,

Nb: 0.01–0.10%,

V: 0.04–0.10%,

N: 0.004–0.009%, and

O: 0.002–0.004%, the balance being Fe and unavoidable impurities, having a chemical composition wherein, among the impurities, B is limited to not more than 0.0003% and the A1 content is limited to not more than 0.005% and having a microstructure wherein area ratio of bainite is not greater than 40% and the remainder is ferrite, pearlite and high-carbon island martensite, the area ratio of the high-carbon island martensite being not greater than 5%.

2. A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47 J, characterized in comprising, in percentage weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, having a chemical composition wherein, among the impurities, B is limited to not more than 0.0003% and the A1 content is limited to not more than 0.005%, and having a microstructure wherein area ratio of bainite is not greater than 40% and the remainder is ferrite, pearlite and high-carbon island martensite, the area ratio of the high-carbon island martensite being not greater than 5%.

3. A method of producing a high-strength, high-toughness flange-shaped rolled steel having mechanical properties of a tensile strength of not less than 590 MPa, a yield strength or 0.2% proof strength of not less than 440 MPa and a Charpy impact absorption energy at 0° C. of not less than 47 J, characterized in starting rolling of a slab after heating to a temperature range of 1100–1300° C. and incorporating at least one or a combination of a plurality of the following steps:

1) in the rolling step, applying rolling of not less than 10% in terms of thickness ratio at a flange-shaped steel surface temperature of not higher than 950° C., 2) in the rolling step, applying not less than one water-cooling/rolling cycle such that the water cooled flange-shaped steel surface temperate is not higher than 700° C. and rolling during recuperation, 3) after completion of the rolling, cooling flange-shaped average steel temperature at a cooling rate in the range of 0.1° C.–5° C./s to a temperature range of 700–400° C. and thereafter allowing spontaneous cooling, and 4) after average flange-shaped steel temperature has once been cooled to not higher than 400° C., reheating to a temperature range of 400–500° C., retaining for 15 minutes to 5 hours, and recooling, the slab comprising, in percentage by weight,

C: 0.02–0.06%,

Si: 0.05–0.25%,

Mn: 1.2–2.0%,

Cu: 0.3–1.2%,

Ni: 0.1–2.0%

Ti: 0.005–0.025%,

Nb: 0.01–0.10%,

V: 0.04–0.10%,

N: 0.004–0.009%, and

O: 0.002–0.004%, the balance being Fe and unavoidable impurities, and having a chemical composition wherein among the impurities B is limited to not more than 0.0003% and the A1 content is limited to not more than 0.005%.

4. A method of producing a high-strength, high-toughness flange-shaped rolled steel having mechanical properties of a tensile strength of not less than 590 MPa, a yield strength or 0.2% proof strength of not less than 440 MPa and a Charpy impact absorption energy at 0° C. of not less than 47 J, characterized in starting rolling of a slab after heating to a temperature range of 1100–1300° C. and incorporating at least one or a combination of a plurality of the following steps:

1) in the rolling step, applying rolling of not less than 10% in terms of thickness ratio at a flange-shaped steel surface temperature of not higher than 950° C., 2) in the rolling step, applying not less than one water-cooling/rolling cycle such that the water cooled flange-shaped steel surface temperature is not higher than 700° C. and rolling during recuperation, 3) after completion of the rolling, cooling average flange-shaped steel temperature at a cooling rate in the range of 0.1° C.–5° C./s to a temperature range of 700–400° C. and thereafter allowing spontaneous cooling, and 4) after average flange-shaped steel temperature has once been cooled to not higher than 400° C., reheating to a temperature range of 400–500° C., retaining for 15 minutes to 5 hours, and recooling, the slab comprising, in percentage by weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, and having a chemical composition wherein among the impurities B is limited to not more than 0.0003% and the A1 content is limited to not more than 0.005%.

5. A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47 J, characterized in comprising, in percentage by weight,

C: 0.02–0.06%,

Si: 0.05–0.25%,

Mn: 1.2–2.0%,

Cu: 0.3–1.2%,

Ni: 0.1–2.0%,

Ti: 0.005–0.025%,

Nb: 0.01–0.10%,

V: 0.04–0.10%,

N: 0.004–0.009%, and

O: 0.002–0.004%, the balance being Fe and unavoidable impurities, having a chemical composition wherein among the impurities B is limited to not more than 0.0003% and the A1 content is limited to not more than 0.005%, and being produced by hot rolling a sectional shape comprising two or more plates each plate having a thickness in the range of 15–80 mm and the ratio of the thickness of each plate to one another is in the range of 0.5–2.0.

6. A high-strength, high-toughness rolled steel shape having mechanical properties of a tensile strength of not less than 590 MPa, a yield strength or 0.2% proof strength of not less than 440 MPa and a Charpy impact absorption energy at 0° C. of not less than 47 J, characterized in comprising, in percentage by weight,

C: 0.02–0.06%,

Si: 0.05–0.25%,

Mn: 1.2–2.0%,

Cu: 0.3–1.2%,

Ti: 0.005–0.025%,

Nb: 0.01–0.10%,

V: 0.04–0.10%,

N: 0.004–0.009%,

O: 0.002–0.004%, and at least one of Cr: 0.1–1.0%, Ni: 0.1–2.0%, Mo: 0.05–0.40%, Mg: 0.0005–0.0050% and Ca: 0.001–0.003%, the balance being Fe and unavoidable impurities, having a chemical composition wherein among the impurities B is limited to not more than 0.0003% and the A1 content is limited to not more than 0.005%, and being produced by hot rolling a sectional shape comprising two or more plates each plate having a thickness in the range of 15–80 mm and the ratio of the thickness of each plate to one another is in the range of 0.5–2.0.

* * * * *